US011647329B2

(12) United States Patent
Matsushita et al.

(10) Patent No.: US 11,647,329 B2
(45) Date of Patent: May 9, 2023

(54) MICROPHONE UNIT

(71) Applicant: HOSIDEN CORPORATION, Osaka (JP)

(72) Inventors: Tsutomu Matsushita, Fukuoka (JP); Hiroyuki Harano, Fukuoka (JP); Ryuji Awamura, Fukuoka (JP); Kensuke Nakanishi, Fukuoka (JP)

(73) Assignee: HOSIDEN CORPORATION, Osaka (JP)

( * ) Notice: Subject to any disclaimer, the term of this patent is extended or adjusted under 35 U.S.C. 154(b) by 0 days.

(21) Appl. No.: 17/585,044

(22) Filed: Jan. 26, 2022

(65) Prior Publication Data

US 2022/0248132 A1 Aug. 4, 2022

(30) Foreign Application Priority Data

Feb. 3, 2021 (JP) ..... JP2021-015695

(51) Int. Cl.
*H04R 1/44* (2006.01)
*H04R 1/08* (2006.01)

(52) U.S. Cl.
CPC ..... *H04R 1/44* (2013.01); *H04R 1/08* (2013.01)

(58) Field of Classification Search
CPC . H04R 1/44; H04R 1/08; H04R 1/086; H04R 1/04; H04R 1/02; H04R 2499/11; H04R 1/28; H04R 2201/02; G10K 9/22; G10K 2200/11; G10K 2210/127
USPC ..... 381/322, 189, 355, 359, 165
See application file for complete search history.

(56) References Cited

U.S. PATENT DOCUMENTS 6,188,773 B1 * 2/2001 Murata ..... H04R 1/005 381/361
10,491,978 B1 * 11/2019 Lin ..... H04R 1/44
2016/0234594 A1 8/2016 Ogura et al.
2018/0081406 A1 * 3/2018 Kita ..... H04R 9/06

FOREIGN PATENT DOCUMENTS

WO WO 2015/056443 A1 4/2015

* cited by examiner

*Primary Examiner* — Norman Yu
(74) *Attorney, Agent, or Firm* — Greenblum & Bernstein, P.L.C.

(57) ABSTRACT

A microphone unit including a tubular case having an opened top and an opened bottom, a waterproof film made of metal that has a thickness of 0.01 mm or more and 0.05 mm or less, a hardness of 100 HV or more, a proof stress of 70 N/mm$^2$ or more, and a tensile strength of 350 N/mm$^2$ or more, the waterproof film being fixed to the bottom of the case so as to block an opening part of the bottom of the case, a substrate arranged in the case, a microphone mounted on the substrate, and a sealing member that seals an opening part of the top of the case.

13 Claims, 4 Drawing Sheets

MICROPHONE UNIT

TECHNICAL FIELD

The present invention relates to a microphone unit.

BACKGROUND ART

International Publication No. WO2015/056443 (hereinafter referred to as Patent Literature 1) discloses a microphone having a waterproof mechanism as a conventional example.

The microphone disclosed in Patent Literature 1 includes a diaphragm, a housing the inside of which is processed into a hemispherical surface, a parabolic curved surface or a conical surface, an acoustic transducer for converting sound pressure into an electric signal, and a wiring for transmitting the electric signal from the acoustic transducer to the outside. A sound pressure input surface of the acoustic transducer is arranged on a bottom surface part of the hemispherical surface, the parabolic curved surface, or the conical surface of the inside of the housing, and a waterproof mechanism for preventing infiltration of water is provided to the diaphragm and the housing, and also provided to the housing and the wiring.

Not so many conventional waterproof mechanisms have exhibited performance of withstanding a water resistance test of the highest level IPX9K (ISO20653, JISD5020) in an in-vehicle IP (K) test. Further, a method for implementing a microphone satisfying such performance requirements in a compact size and at low cost has not been known.

SUMMARY OF THE INVENTION

Therefore, an object of the present invention is to provide a compact and low-cost microphone unit that can conform to the highest level IPX9K of an in-vehicle IP (K) test.

A microphone unit according to the present invention comprises: a tubular case having an opened top and an opened bottom; a waterproof film made of metal that has a thickness of 0.01 mm or more and 0.05 mm or less, a hardness of 100 HV or more, a proof stress of 70 N/mm$^2$ or more, and a tensile strength of 350 N/mm$^2$ or more, the waterproof film being fixed to the bottom of the case so as to block an opening part of the bottom of the case; a substrate arranged in the case; a microphone mounted on the substrate; and a sealing member that seals an opening part of the top of the case.

Effects of the Invention

According to the present invention, it is possible to realize a compact and low-cost microphone unit that can comfort to the highest level IPX9K of the in-vehicle IP (K) test.

DETAILED DESCRIPTION

Figure 1:
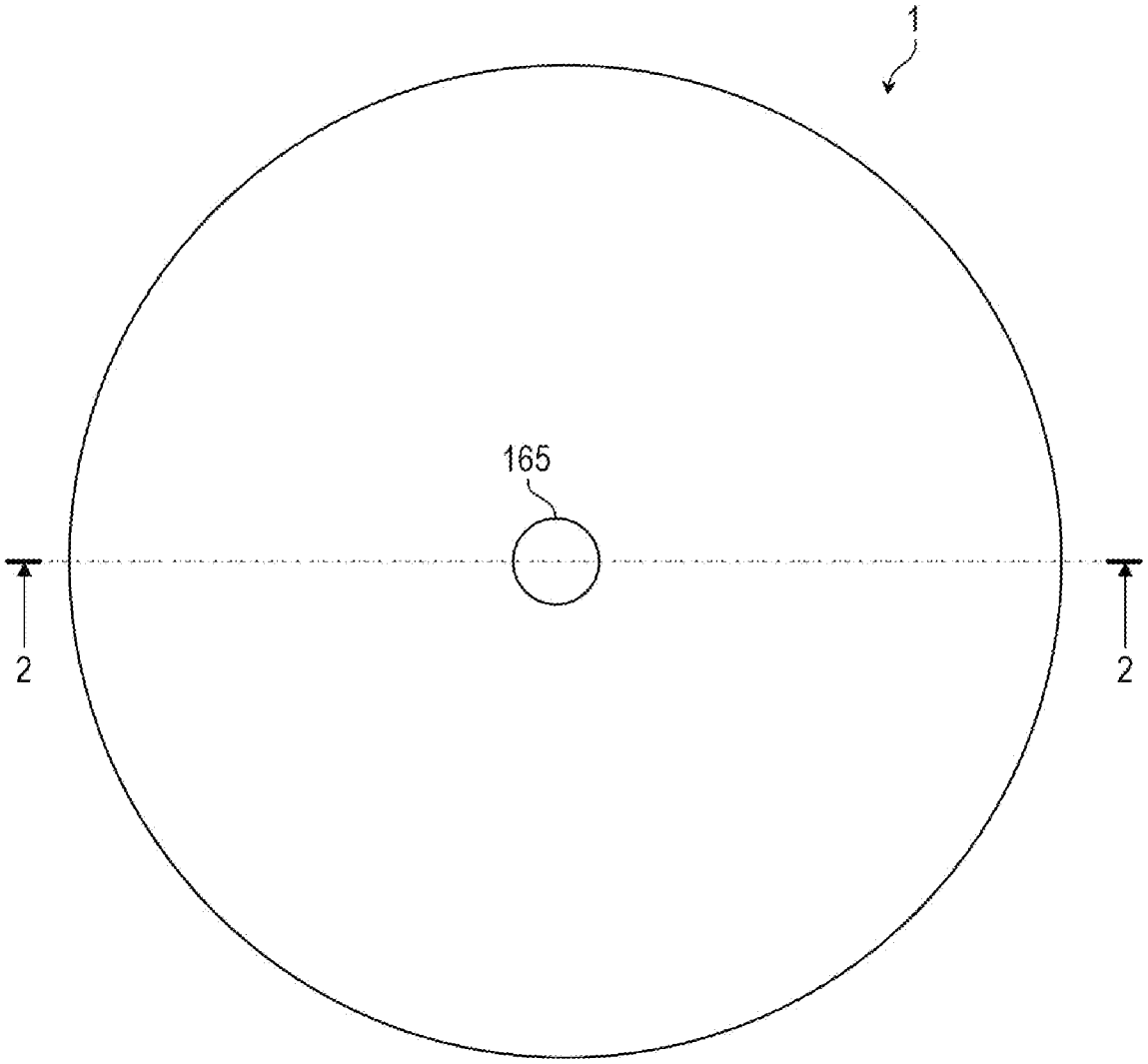
FIG. 1 is a plan view of microphone units of a first embodiment and a first modification.

Hereinafter, an embodiment of the present invention will be described in detail. Components having the same functions are designated by the same reference numerals, and duplicate description thereof will be omitted.

First Embodiment

Figure 2:
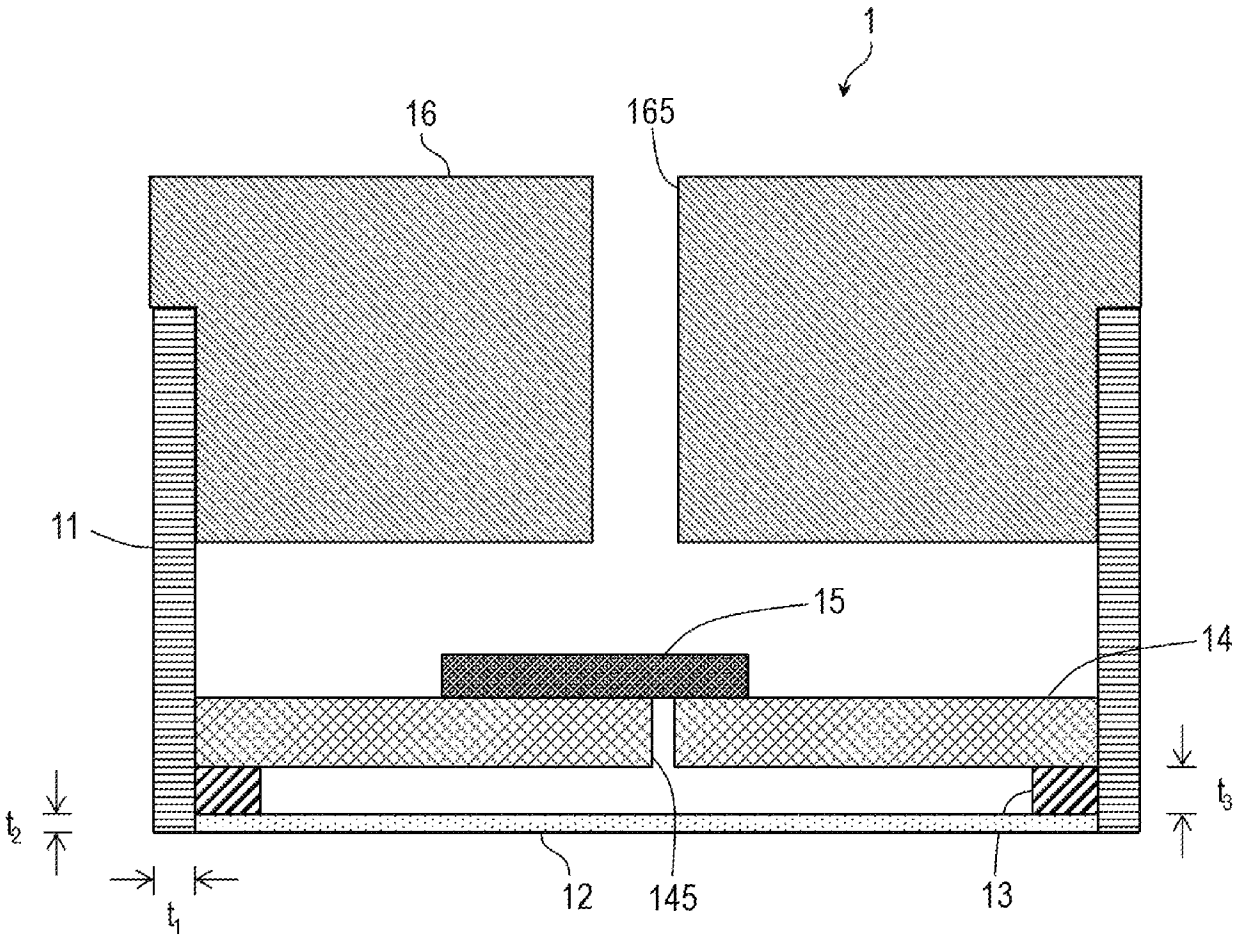
FIG. 2 is a cross-sectional view of the microphone unit of the first embodiment based on a cutting line 2-2 and a projection direction indicated by arrows in FIG. 1.

Hereinafter, the structure of a microphone unit of a first embodiment will be described with reference to FIGS. 1 and 2. As shown in FIG. 2, the microphone unit 1 of the present embodiment comprises a tubular case 11 having an opened top and an opened bottom, a waterproof film 12 made of metal which is fixed to the bottom of the case 11 so as to block an opening part of the bottom of the case 11, a spacer 13 made of a conductive material which is pinched between the substrate 14 and the waterproof film 12, a substrate 14 arranged in the case 11, a microphone 15 mounted on the substrate 14, and a sealing member 16 for sealing an opening part of the top of the case 11. A hole 145 is formed in the substrate 14, and a hole 165 is formed in the sealing member 16. An amplifier circuit, a filter circuit, and an equalizer circuit are mounted on the substrate 14 as electronic circuits for adjusting characteristics. In the present embodiment, a MEMS microphone is assumed, but this can be replaced with an ECM or a dynamic microphone. When an ECM or dynamic microphone is used, the heat resisting temperature changes, so that it is necessary to pay attention to this point when designing.

For the case 11 is selected a material that can withstand a high water pressure (for example, 10 MPa), and is compatible with the material of a vibrating film. For example, a SUS case may be used. The thickness of the case 11 ($t_1$ in FIG. 2) is suitably set to about 0.2 mm to 3.0 mm.

For the material of the waterproof film 12 is suitable a material that has no air permeability, has springiness, and returns to its original shape even when it is pressed and deformed, and a metal thin film that is not easily corroded, for example, a SUS film may be used, which improves water resistance and waterproofness. Similar performance can be achieved by using a thin film of resin as the waterproof film 12.

Further, the waterproof film 12 is configured to have a thickness ($t_2$ in FIG. 2) of 0.01 mm or more and 0.05 mm or less, a hardness of 100 HV or more, a proof stress of 70 N/mm$^2$ or more, and a tensile strength of 350 N/mm$^2$ or more, whereby it is possible to achieve a waterproof structure that meets the highest level of IPX9K in the in-vehicle IP (K) test. Elongation of 10% or more may be set as an additional condition. As a result, the microphone unit 1 of the present embodiment can be used as an external microphone because it can achieve a waterproof structure that can withstand high-pressure washing.

The waterproof film 12 may be fixed to the bottom of the case 11 by spot welding or seam welding. Further, the waterproof film 12 may be bonded to the bottom of the case 11 with an adhesive or a strong double-sided adhesive tape. By firmly bonding the waterproof film 12 and the case 11, the bonded part will not be damaged even under high water pressure (for example, 10 MPa).

The distance between the substrate 14 and the waterproof film 12 is a parameter for adjusting the sensitivity, and the optimum value thereof also varies depending on the structure and the vibration diameter. For example, when the film thickness of the waterproof film 12 (SUS film) is set to 30 μm and the outer diameter thereof is set to ϕ14 (vibration diameter: ϕ12), the distance between the substrate 14 and the waterproof film 12 is suitably set to 0.01 mm to 0.5 mm. In the present embodiment, the height of the spacer 13 ($t_3$ in FIG. 2) is set to 0.1 mm or more and 0.5 mm or less to provide a gap between the substrate 14 and the waterproof film 12, whereby the distance between the substrate 14 and the waterproof film 12 is set to 0.1 mm or more and 0.5 mm or less.

Further, by adjusting the distance between the substrate 14 and the waterproof film 12, the microphone unit is structured such that the substrate 14 supports the waterproof film 12 even under high water pressure (for example, 10 MPa), so that the limit of the proof stress of the waterproof film 12 is hardly exceeded and the restoration time of the waterproof film 12 can be shortened.

It is also possible to further miniaturize the microphone unit 1 by reducing the diameter of the microphone unit 1 and making the film thickness of the waterproof film 12 smaller.

When the substrate 14 and the case 11 are joined to each other, the substrate 14 and the case 11 may be joined to each other by pressing from above with a highly elastic adhesive or a structure such as a cap. It is possible to cope with atmospheric pressure fluctuation occurring at a temperature of 105° C. to −40° C. by the springiness of the waterproof film 12 and the fixing method of the substrate 14 (a method using a highly elastic adhesive).

Figure 3:
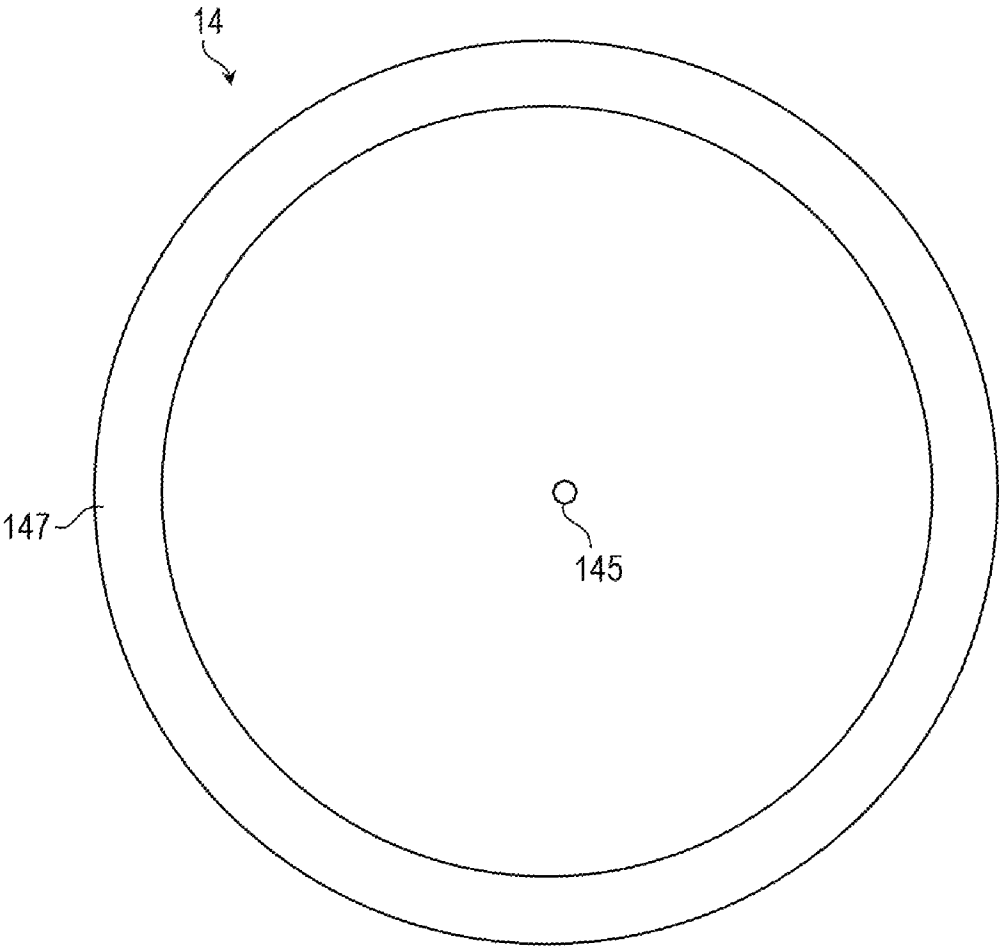
FIG. 3 is a bottom view of a substrate.

As shown in FIG. 3, a GND pattern 147 is provided on the outer edge of the bottom surface of the substrate 14, and the GND pattern 147 and the spacer 13 (conductive material) are brought into contact with (connected to) each other, whereby the case 11 and the waterproof film 12 can be used as a shield, so that resistance to static electricity and electromagnetic noise is improved. When the spacer 13 is made of a non-conductive material, it can be replaced by forming a GND pattern on the surface of the substrate 14 and connecting the GND pattern to the case 11 with a conductive material.

First Modification

Figure 4:
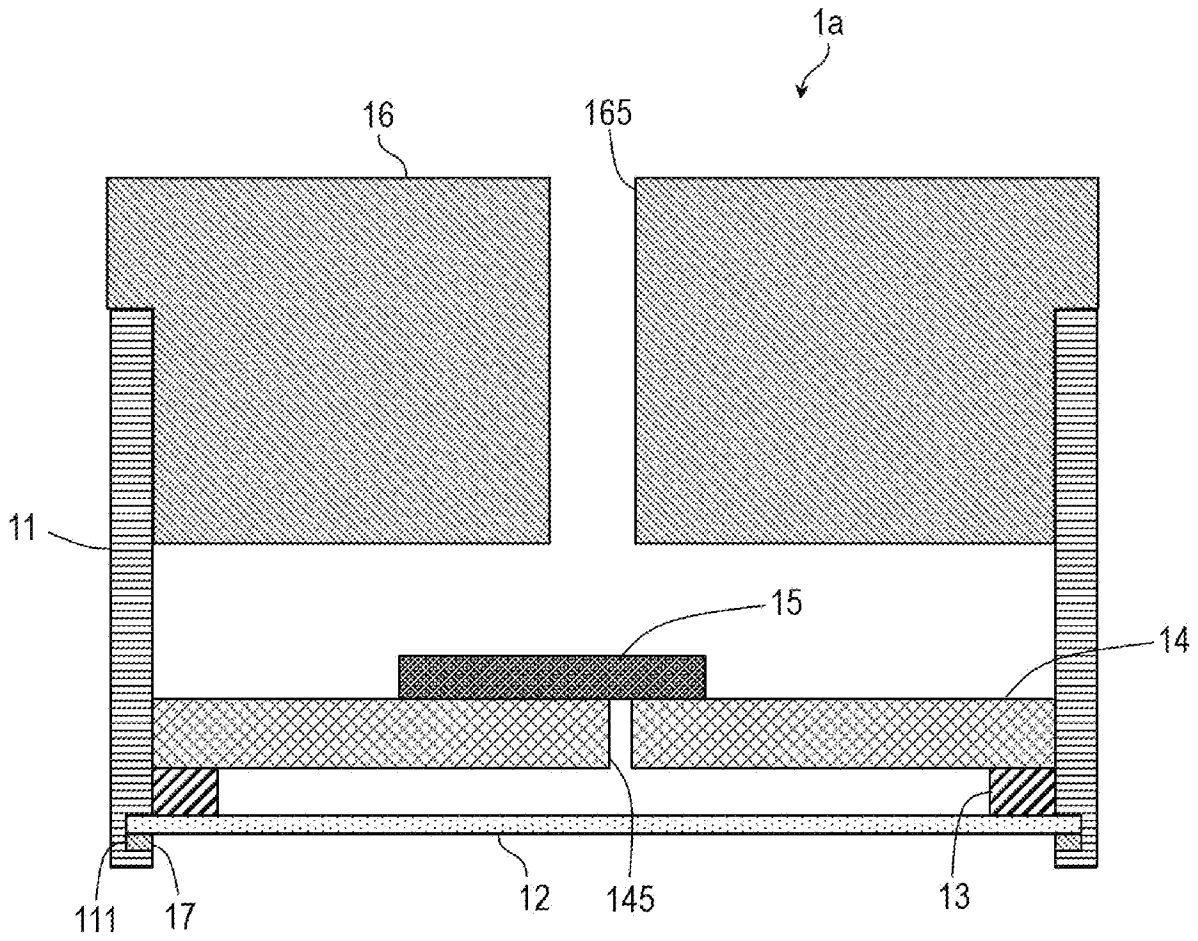
FIG. 4 is a cross-sectional view of the microphone unit of the first modification based on the cutting line 2-2 and the projection direction indicated by the arrows in FIG. 1.

As shown in FIG. 4, the waterproof film 12 may be fixed to the lower end of the case 11 by press-fitting the waterproof film 12 and a washer 17 into a groove 111 provided on the inner circumference of the lower end of the case 11 so that the waterproof film 12 and the washer 17 are fitted (clamped) to each other. The waterproof film 12 is fixed by spot welding or seam welding as in the case of the first embodiment, or the waterproof film 12 is clamped together with the washer 17 as in the case of the first modification, whereby the structure can withstand a pressure of 10 MPa and a water pressure under water.

<Usage of the Microphone Units of the First Embodiment and the First Modification>

The microphone units of the first embodiment and the first modification can be used for the following articles, for example.

1) Waterproof microphone, outdoor microphone, external microphone

2) Vending machine (voice recognition microphone)

3) Security camera

4) Entrance door (voice recognition microphone, intercom, etc.)

5) Vehicle backward warning buzzer control microphone

6) Keyless unlocking/locking answerback sound control microphone

7) Failure detection of heavy machinery and robots

What is claimed is:

1. A microphone unit comprising:

a tubular case having an opened top and an opened bottom;

a waterproof film made of metal that has a thickness of 0.01 mm or more and 0.05 mm or less, a hardness of 100 HV or more, a proof stress of 70 N/mm$^2$ or more, and a tensile strength of 350 N/mm$^2$ or more, the waterproof film being fixed to the bottom of the case so as to block an opening part of the bottom of the case;

a substrate arranged in the case;

a microphone mounted on the substrate; and a sealing member that seals an opening part of the top of the case.

2. The microphone unit according to claim 1, wherein a gap is provided between the substrate and the waterproof film so that a distance between the substrate and the waterproof film is 0.01 mm or more and 0.5 mm or less.

3. The microphone unit according to claim 2, further comprising a spacer made of a conductive material which is pinched between the substrate and the waterproof film and connected to GND of the substrate.

4. The microphone unit according to claim 1, wherein the waterproof film is fixed to the bottom of the case by spot welding.

5. The microphone unit according to claim 2, wherein the waterproof film is fixed to the bottom of the case by spot welding.

6. The microphone unit according to claim 3, wherein the waterproof film is fixed to the bottom of the case by spot welding.

7. The microphone unit according to claim 1, wherein the waterproof film is fixed to the bottom of the case by seam welding.

8. The microphone unit according to claim 2, wherein the waterproof film is fixed to the bottom of the case by seam welding.

9. The microphone unit according to claim 3, wherein the waterproof film is fixed to the bottom of the case by seam welding.

10. The microphone unit according to claim 1, wherein the waterproof film is fixed by fitting the waterproof film into a groove provided on an inner circumference of a lower end of the case.

11. The microphone unit according to claim 2, wherein the waterproof film is fixed by fitting the waterproof film into a groove provided on an inner circumference of a lower end of the case.

12. The microphone unit according to claim 3, wherein the waterproof film is fixed by fitting the waterproof film into a groove provided on an inner circumference of a lower end of the case.

13. The microphone unit according to claim 1, wherein an amplifier circuit, a filter circuit, and an equalizer circuit are mounted on the substrate as electronic circuits.

* * * * *